US006482135B1

(12) United States Patent
Ish, III et al.

(10) Patent No.: US 6,482,135 B1
(45) Date of Patent: Nov. 19, 2002

(54) APPARATUS AND METHODS FOR EXERCISE MACHINES HAVING BALANCING LOADS

(75) Inventors: A. Buell Ish, III, Redmond, WA (US); L. Kent Lines, Carnation, WA (US); William D. MacLean, Redmond, WA (US)

(73) Assignee: Vectra Fitness, Inc., Kent, WA (US)

( * ) Notice: Subject to any disclaimer, the term of this patent is extended or adjusted under 35 U.S.C. 154(b) by 0 days.

(21) Appl. No.: 09/499,253

(22) Filed: Feb. 7, 2000

(51) Int. Cl.[7] ..... A63B 21/062; A63B 21/08; A63B 21/078

(52) U.S. Cl. ..... 482/97; 482/100; 482/133

(58) Field of Search ..... 482/93, 94, 97–103, 482/135–138

(56) References Cited

U.S. PATENT DOCUMENTS

| | | | | | |
|---|---|---|---|---|---|
| 4,336,934 | A | * | 6/1982 | Hanagan et al. | 482/97 |
| 4,600,188 | A | * | 7/1986 | Bangerter et al. | 482/100 |
| 4,711,448 | A | | 12/1987 | Minkow et al. | |
| 4,974,835 | A | * | 12/1990 | Klink | 482/97 |
| 4,986,538 | A | | 1/1991 | Ish, III | |
| 5,263,915 | A | | 11/1993 | Habing | |
| RE34,572 | E | | 3/1994 | Johnson et al. | |
| RE34,577 | E | | 4/1994 | Habing et al. | |
| 5,304,108 | A | * | 4/1994 | Denega et al. | 482/93 |
| 5,336,148 | A | | 8/1994 | Ish, III | |
| 5,362,290 | A | | 11/1994 | Huang | |
| 5,518,477 | A | | 5/1996 | Simonson | |
| 5,605,523 | A | | 2/1997 | Ish, III et al. | |
| 5,683,334 | A | | 11/1997 | Webber | |
| 5,749,813 | A | * | 5/1998 | Domzalski | 482/137 |
| 5,779,601 | A | | 7/1998 | Ish, III | |
| 5,857,941 | A | | 1/1999 | Maresh et al. | |
| 5,957,817 | A | * | 9/1999 | Koenig et al. | 482/137 |
| 6,264,585 | B1 | * | 7/2001 | Beauchamp | 482/137 |

FOREIGN PATENT DOCUMENTS

| | | | | |
|---|---|---|---|---|
| DE | 208552 | * | 4/1984 | 482/93 |
| DE | 244070 A1 | * | 3/1987 | 482/97 |
| DE | 244071 A1 | * | 3/1987 | 482/97 |

* cited by examiner

*Primary Examiner*—Jerome W. Donnelly
*Assistant Examiner*—Victor K. Hwang
(74) *Attorney, Agent, or Firm*—Dorsey & Whitney LLP

(57) ABSTRACT

Apparatus and methods for exercise machines having balancing loads. In one embodiment, an apparatus includes a load guide pivotable through at least one plane of freedom, a load slideably engaged with the load guide, a lift arm having a first end coupled to the load guide, and a cable-and-pulley device. The cable-and-pulley device is operatively coupled to the load and to the lift arm so that a training force applied to the lift arm induces a lift force on the load. The exercise machine requires the user to balance the load as the load is raised, providing a more enhanced workout. In alternate embodiments, the load guide may include at least one rocker engageable with the floor surface, or may be pivotably coupled to a support frame (or base) so that the load guide does not contact the floor surface. In another embodiment, the load guide may include a base having a convex surface engageable with the floor surface, the load guide being pivotable in any direction. In a further embodiment, an apparatus includes a support having a first end proximate the floor, the support being pivotable about the first end, a lift member pivotably coupled to the support, and a load coupled to the lift member. As a training force is applied to the lift member, the load is at least partially balanceable on the support by the training force. In alternate embodiments, the support may be pivotable in a single plane of freedom, or in two planes of freedom. Alternately, the load may be coupled to the lift member by a force-transmitting device, such as a cable-and-pulley device, a linkage, a belt, or other suitable device.

26 Claims, 10 Drawing Sheets

APPARATUS AND METHODS FOR EXERCISE MACHINES HAVING BALANCING LOADS

TECHNICAL FIELD

The present invention relates to apparatus and methods for exercise machines having balancing loads.

BACKGROUND OF THE INVENTION

The convenience, efficiency, and safety of weight-training exercise machines is widely recognized. Popular weight-training exercise machines feature single or multiple stations at which a user may perform one or a variety of exercises for developing and toning different muscle groups of the user's body. One of the stations typically allows a user to perform a variety of exercises, including "press" and "shrug" exercises which train muscles of the upper body, including chest, shoulder, and arm muscles, and "squat" and "calf" exercises which train muscles of the legs.

For example, FIG. 1 is an elevational view of an exercise machine 100 having a weight stack 102 and a lift arm 104. The lift arm 104 includes a first end coupled to a fixed support 105, and a second end having a pair of handles 109. The weight stack 102 includes a plurality of weights 103, each of which is slideable on a pair of guide rods 106 (only one visible). The guide rods 106 include a lower end 107 pivotably coupled to a fixed base 108. With the lift arm 104 in a lowered position 110, the guide rods 106 are in an approximately vertical position. A selector pin 112 is inserted into the weight stack 102 to select a desired number of lifted plated 114. Exercise machines of the type shown in FIG. 1 are disclosed, for example, in U.S. Pat. No. 5,336,148 to Ish, incorporated herein by reference.

In operation, a user (not shown) may perform a "press" exercise by lying on a bench 111 and grasping the handles 109. The user then applies a training force to the handles 109 by pressing the handles 109 away from the user's chest. As the user overcomes the gravitational force on the lifted plates 114, the handles 109 move along a fixed arc 116, moving the lift arm 104 into a second position 120. As the handles 109 move along the arc 116, the lifted plates 114 move upwardly along the guide rod 106 and the guide rods 106 pivot into a tilted, non-vertical position 122. The shape and location of the arc 116 defined by the movement of the handles 109 is fixed. As shown in FIG. 2, the above-described press exercise trains a muscle zone 132 of a user's upper body 130.

Other known exercise machines allow greater freedom of movement of the handles of the lift arm. For example, FIG. 3 is an elevational view of an exercise machine 150 having a press station 152 and a pull-down station 154. The press station 152 includes a seat 153 and a lift arm 154. The lift arm 154 includes a first end pivotably attached to a support arm 155 by a hinge 157 and a second end proximate the seat 153 having a pair of handles 156. In a lowered position 180, the hinge 157 is engaged against a support frame 162.

The exercise machine 150 further includes a weight stack 158 slideably engaged with a weight guide 160, allowing the user to select a desired training load. A cable-and-pulley device 170 operatively couples the lift arm 154 to the weight stack 158 to apply a lifting force to the training load when a user applies a training force to the handles 156. Exercise machines of the type shown in FIG. 3 are disclosed, for example, in U.S. Pat. No. 4,986,538 to Ish, incorporated herein by reference.

As shown in FIG. 3, the cable-and-pulley device 170 includes a cable 172 having a first end attached to the weight stack 158. The cable 172 is trained over a first pulley 178 attached to an upper end of the load guide 160. As fully described in the '538 patent, the first cable 172 is coupled to a second cable by a first double floating pulley (not shown), which is in turn coupled to a third cable 173 by a second double floating pulley (not shown). The third cable 173 is trained over a second pulley 174 and is attached to the lift arm 154. Generally, a variety of cable-and-pulley device configurations may be used, including, for example, the cable-and-pulley device configurations disclosed in U.S. Pat. No. Re. 34,572 to Johnson and Ish, U.S. Pat. No. 5,971,896 to Gianelli et al, and U.S. Pat. No. 5,928,112 to Jones et al.

In operation, a user sits on the seat 153 and applies a training force on the handles 156. As shown in FIG. 3, as the user overcomes the gravitational force on the training load, the handles 156 may be moved throughout a training zone 186 approximately defined by the lowered position 180, an intermediate position 182, and a raised position 184. Because the hinge 157 is not rigidly attached to the support frame 162, the handles 156 are not constrained to follow a fixed arc, but rather, may freely move throughout the training zone 186 as the training load is raised by the user.

Beneficial results have been achieved using the above-described exercise machines. In some cases, however, it may be desirable to augment these beneficial results by increasing the amount of work the user must perform during press exercises. Increasing the work performed by the user may be desirable, for example, to expand the scope of the trained muscle zone, to more thoroughly train the muscle zone, or to train additional or secondary muscles not typically trained by conventional press exercise machines.

SUMMARY OF THE INVENTION

The present invention is directed to apparatus and methods for exercise machines having balancing loads. In one aspect, an exercise machine includes a load guide that is pivotable in at least one plane of freedom. The machine further includes a load that is engaged with the load guide, a lift arm having a first end coupled to the load guide, and a cable-and-pulley device operatively coupled to the load and to the lift arm so that a training force applied to the lift arm induces a lift force on the load. As the lift force overcomes a gravitational force on the load, the load is raised. The exercise machine requires the user to balance the load as the load is raised, providing an enhanced workout.

In another aspect, the load guide includes at least one rocker engageable with the floor surface and is pivotable in one plane of freedom. Alternately, the load guide may be pivotably coupled to a support frame (or base) so that the load guide does not contact the floor surface. In a further aspect, the load guide may include a base having a convex surface engageable with the floor surface, the load guide being pivotable in any direction.

In another aspect, an exercise machine includes a support member proximate the load guide. The support member may include a locking device engageable with the load guide to secure the load guide in a fixed position, such as in a vertical position. In a further aspect, an exercise machine includes a lift arm having a centering arm, and a centering support engageable with the centering arm. The centering arm and centering support automatically position the pivotable load guide into an upright position when the user lowers the lift arm.

In a further aspect, an exercise machine includes a support having a first end proximate the floor, the support being pivotable about the first end, a lift member pivotably coupled to the support, and a load coupled to the lift member. As a training force is applied to the lift member, the load is at least partially balanceable on the support by the training force. In alternate embodiments, the support may be pivotable in a single plane of freedom, or in two planes of freedom. Alternately, the load may be coupled to the lift member by a force-transmitting device, such as a cable-and-pulley device, a linkage, a belt, or other suitable device.

DETAILED DESCRIPTION OF THE INVENTION

The present invention is generally directed toward apparatus and methods for strength training incorporating balancing of resistance. Many specific details of certain embodiments of the invention are set forth in the following description and in FIGS. 4–18 to provide a thorough understanding of such embodiments. One skilled in the art will understand, however, that the present invention may have additional embodiments, or that the present invention may be practiced without several of the details described in the following description.

Figure 4:
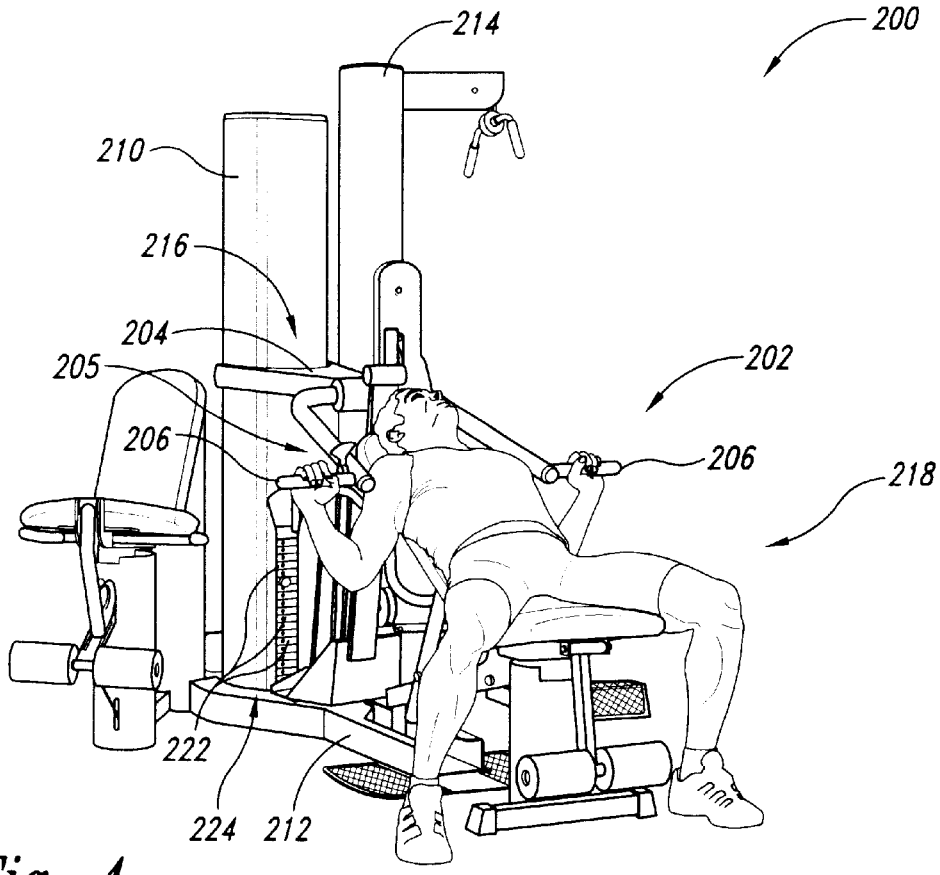
FIG. 4 is an isometric view of an exercise machine in accordance with an embodiment of the invention.

FIG. 4 is an isometric view of an exercise machine 200 in accordance with an embodiment of the invention. The exercise machine 200 includes a press station 202 having a lift arm 204, and an upwardly extending weight guide 210 positioned proximate the press station 202. The exercise machine 200 filter includes a support frame 212 having a support member 214 extending upwardly adjacent to the weight guide 210. The lift arm 204 includes a first end 216 pivotably attached to the weight guide 210, and an outwardly projecting second end 218 that includes a pair of handles 206. An initial position of the lift arm 204 may be pivotably adjusted by means of an actuating assembly 205 located near one of the handles, as described in co-pending and commonly owned U.S. patent application Ser. No. 09/498,697 entitled "Actuator Assemblies for Adjustment Mechanisms of Exercise Machines;" filed concurrently herewith and incorporated herein by reference.

Figure 5:
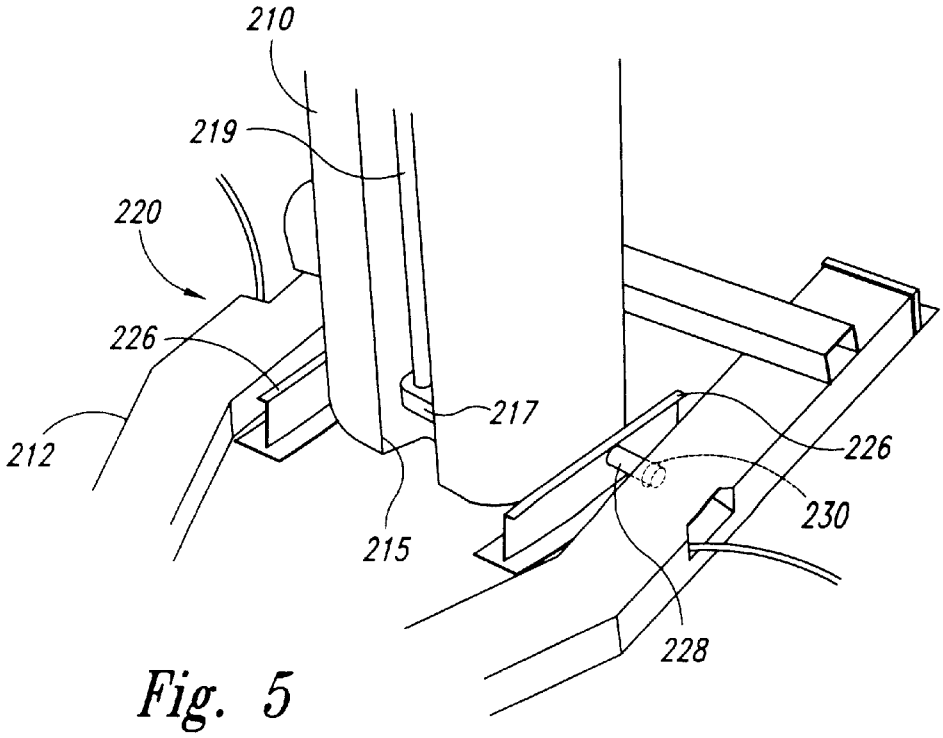
FIG. 5 is an enlarged, partial isometric view of a lower end of a weight guide and support frame of the exercise machine of FIG. 4.
Figure 6:
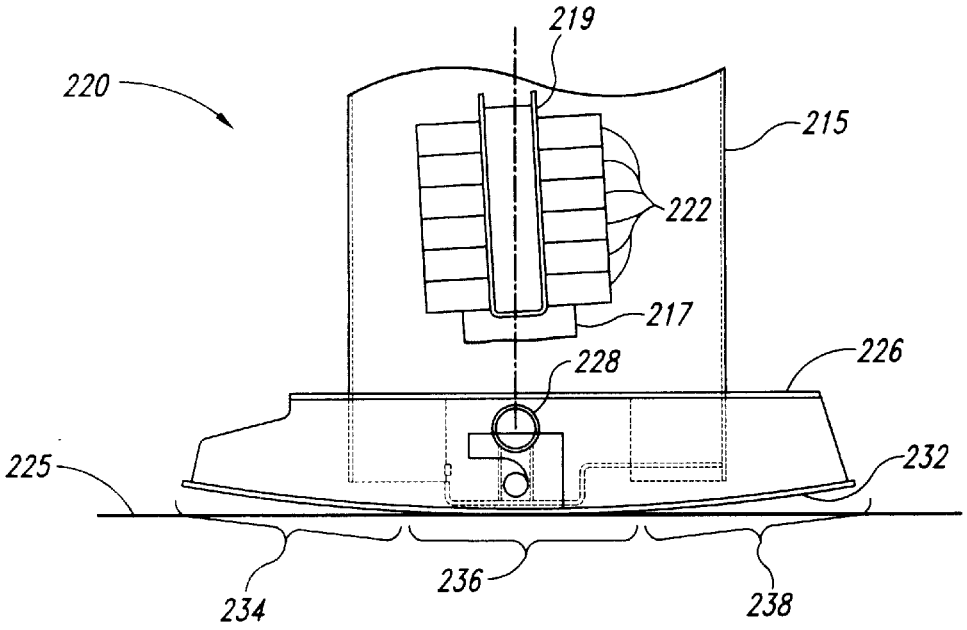
FIG. 6 is an enlarged, partial cross-sectional view of the lower end of the weight guide of FIG. 5.

FIG. 5 is an enlarged, partial isometric view of a lower end 220 of tie weight guide 210 and the support frame 212 of the exercise machine 200 of FIG. 4. In this embodiment, the weight guide 210 includes a thin-walled housing 215 having a pair of guide rods 219 (only one visible) disposed longitudinally therein. A plurality of weight plates 222 (see FIG. 4) are slidably engaged on the guide rods 219 to form a weight stack 224. A pair of rockers 226 are attached to the lower end 220 of the weight guide 210 to support the weight guide 210 and the weight stack 224 on a floor surface 225. A pair of retainer pins 228 (only one visible) are attached to the frame 212 and project outwardly from the frame 212 into a retainer slot 230 disposed within each rocker 226. FIG. 6 is an enlarged, partial cross-sectional view of the lower end 220 of the weight guide 210 of FIG. 5. In this figure, several of the weight plates 222 are shown slideably engaged on the guide rods 219 (only one guide rod 219 visible). The guide rods 219 are ached to a support bar 217 which is in turn attached to the weight guide 210. Each rocker 226 has an arcuate lower sure 232 that rolls on the floor surface 225, allowing the weight guide 210 and the weight stack 224 to pivot or rock back and forth on the rockers 226. The retainer slots 230 allow the retainer pins 228 to translate as the weight guide 210 pivots or rocks back and forth on the rockers 226.

In the embodiment shown in FIG. 6, the arcuate lower surface 232 includes a first portion 234, a second portion 236, and a third portion 238. The first and third portions 234, 238 have larger radii of curvature than the second portion 236, and thus, are flatter (or less curved) than the second portion 236. This feature provides an inherent stabilizing effect on the rockers 226 and improves the stability of the pivotable weight guide 210.

Figure 7:
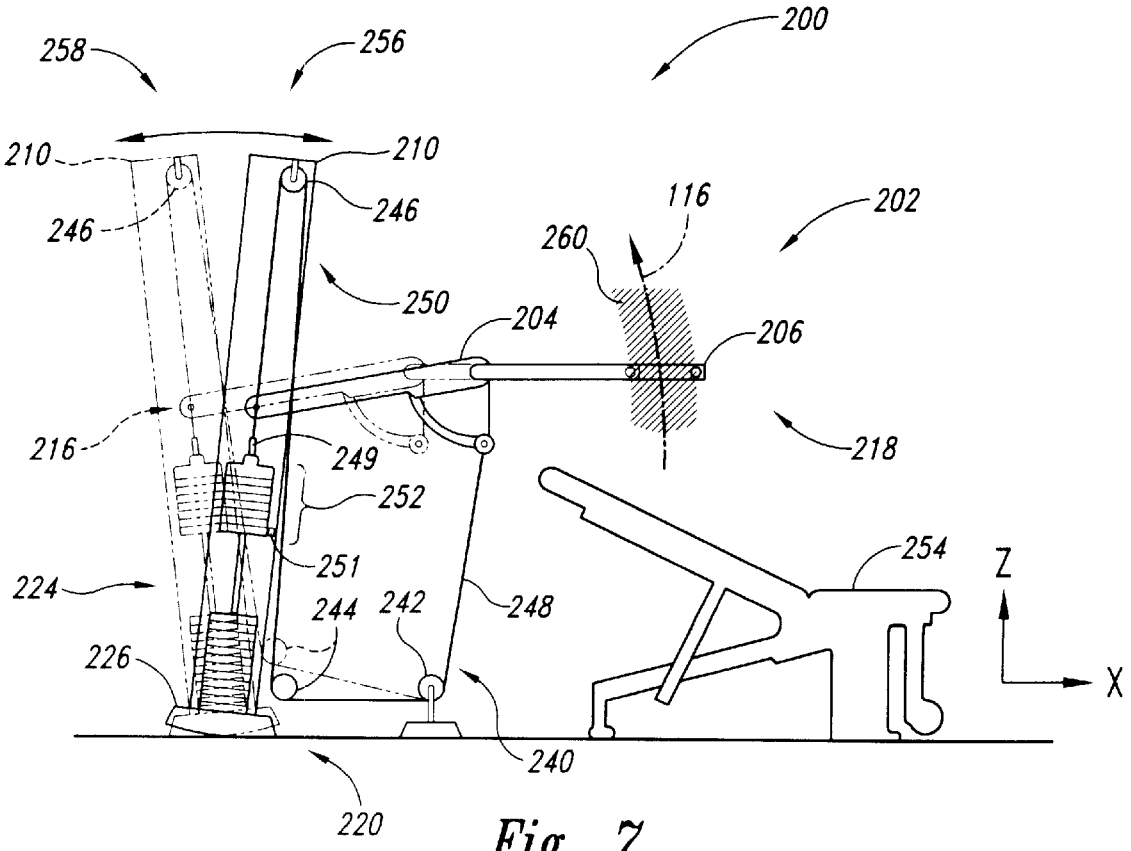
FIG. 7 is a partial side elevational view of a press station of an exercise machine in accordance with an embodiment of the invention.

FIG. 7 is a partial side elevational view of the press station 202 in accordance with an embodiment of the invention. In this embodiment, a simplified embodiment of a cable-and-pulley device 240 is described to allow attention to be focused on other aspects of the invention. A complete description of an alternate embodiment of a cable-and-pulley device 280 that fully enables operation of the press station 202 of the exercise machine 200 of FIG. 4 is provided below with reference to FIG. 10.

As shown in FIG. 7, in this embodiment the press station 202 includes a cable-and-pulley device 240 having a first pulley 242 attached to the support frame 212, a second pulley 244 attached to the lower end 220 of the weight guide 210, and a third pulley 246 attached to an upper end 250 of the weight guide 210. A cable 248 has a first end attached to the lift arm 204 and is trained about the first, second, and third pulleys 242, 244, 246. A second end of the cable 248 is secured to an engagement rod 249 having a plurality of holes disposed there. In an arrangement well-known in the art, the engagement rod 249 slides into the weight stack 224. A user may select a desired training load 252 by inserting a pin 251 through a gap (not shown) between the weight plates 222 and into one of the holes in the engagement rod 249. In this position, the pin 251 attaches a desired number of weight plates 222 to the cable 248 to form the training load 252.

Alternate cable-and-pulley devices may be used. For example, either the first pulley 242 or the second pulley 244 may be eliminated. Alternately, the second pulley 244 may be attached to a component other than the lower end 220 of the weight guide 210, such as the support frame 212. Alternate embodiments of cable-and-pulley devices are described more fully below.

Furthermore, it is not necessary that a cable-and-pulley device be used. A variety of known force-transmitting mechanisms may be used instead of cable-and-pulley devices, including, for example, belts, chains, levers, linkages, direct drives, and hydraulic systems.

Figure 1:
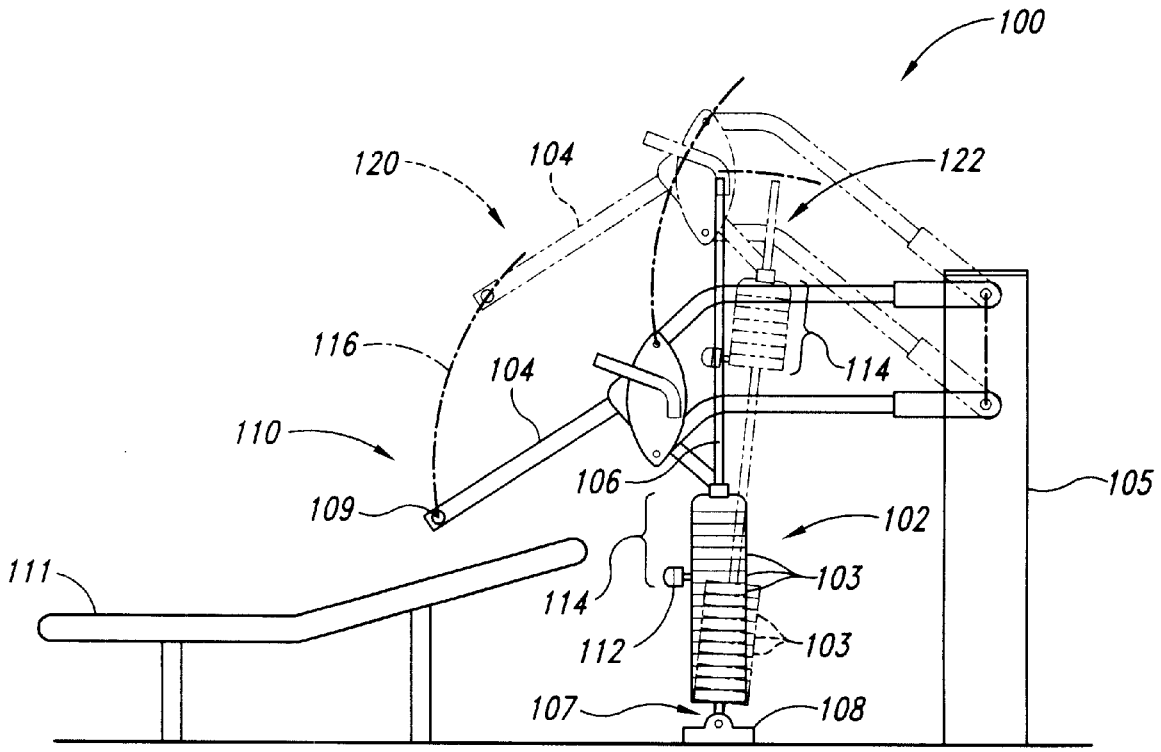
Fig. 1 (Prior Art)
FIG. 1 is an elevational view of an exercise machine in accordance with the prior art.

In a first mode of operation, the user may be positioned on a bench 254 facing toward the handles 206 of the lift arm 204. The user may apply a training force against the handles 206, which is transmitted by the cable-and-pulley device 240 into a lifting force on the training load 252. As the training force applied by the user overcomes the gravitational force on the training load 252, the training load 252 is raised on the guide rods 219 of the weight guide 210. Because the weight guide 210 is pivotable on the rockers 226, the weight guide 210 is free to move between a forward position 256 and an aft position 258. As a result, as the handles 206 are pressed by the user, the handles 206 are free to move fore and aft over a balance zone 260. The movement of the handles 206 is not limited to the fixed arc 116 as in some conventional exercise machines (see FIG. 1).

The exercise machine 200 advantageously requires the user to maintain the balance of the weight guide 210 and the weight stack 224 as the handles 206 are raised during a press exercise. More specifically, the exercise machine 200 requires the user to not only exert force to raise the training load, but also to resist the tendencies of the handles 206 to move fore and aft. Because the weight guide 210 is pivotable (or rockable), and the lift arm 204 is attached directly to the weight guide 210 and not to any fixed support, the handles 206 are free to move with the weight guide 210. The freedom of movement of the handles 206 requires the user to balance the mass of the weight guide 210 and the weight stack 224 during the exercise. As used herein, the term "balance" does not mean that the weight guide 210 must remain vertical. Thus, in this mode of operation, the press exercise more closely resembles a press exercise performed using free weights, such as a bar with one or more weights at each end.

Figure 2:
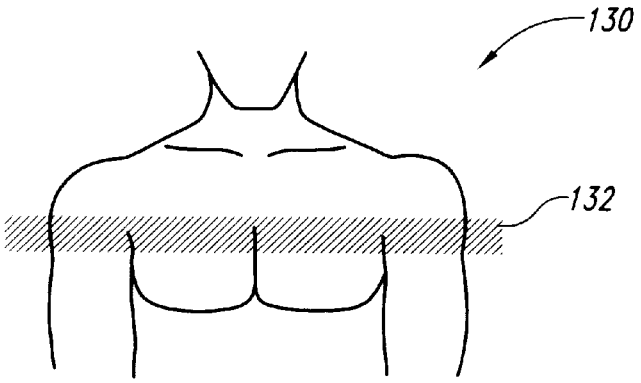
Fig. 2 (Prior Art)
FIG. 2 is a schematic view of a muscle zone of a user's upper body in accordance with the prior art.
Figure 8:
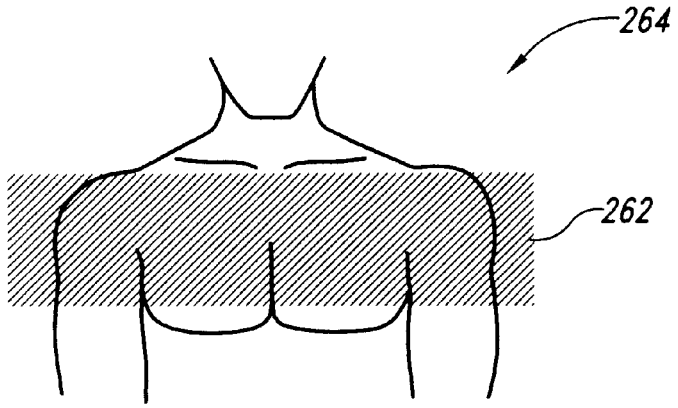
FIG. 8 is a schematic view of an expanded muscle zone of a user's upper body.

Because the user is required to balance the mass of the weight guide 210 and the weight stack 224 during the press exercise, several beneficial results may be achieved. For example, FIG. 8 is a schematic view of an expanded muscle zone 262 of a user's upper body 264. As shown in this figure, the exercise machine 200 requiring the user to balance the load (the weight guide 210 and the weight stack 224) may expand the scope of the trained muscle zone 262 in comparison with the muscle zone 132 trained by some conventional exercise machines (see FIG. 2). Furthermore, the trained muscle zone 262 may be more thoroughly trained due to the requirement that the user must balance the mass during the press exercise. Also, additional or secondary muscles not typically trained by some conventional exercise machines may be needed to control and maintain the balance of the pivotable weight guide 210 during the press exercise.

Although the foregoing description and figures are directed to press exercises, it should be recognized that there will also be a training benefit when a user performs other exercises in the balancing mode, including, for example, squats, shrugs, and standing calf raises. Therefore, throughout this description, the beneficial aspects of exercise machines having balancing loads should be recognized as being applicable to a variety of other exercises and exercise devices, and are not limited to the embodiments shown in the figures and described herein.

Figure 3:
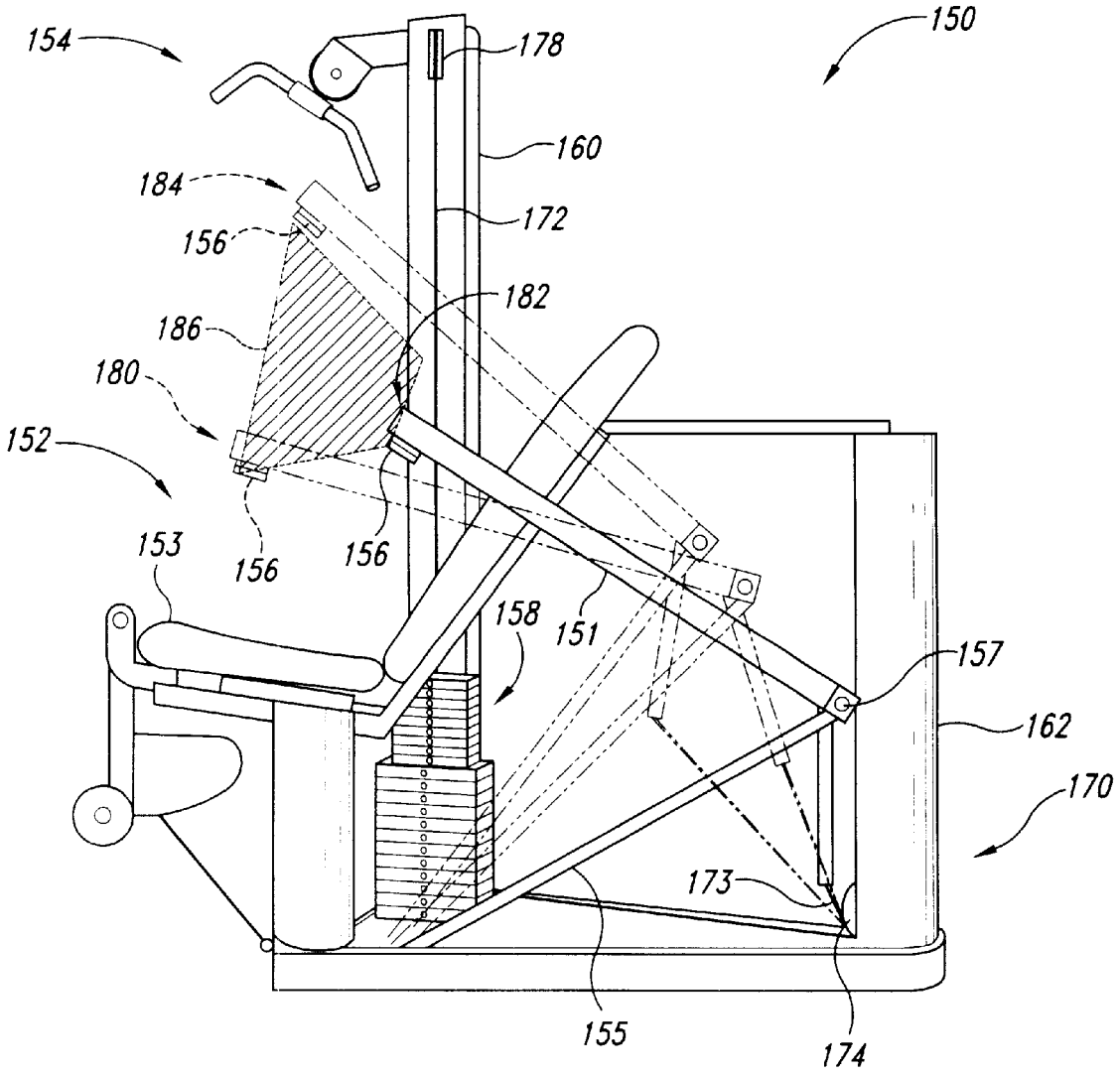
Fig. 3 (Prior Art)
FIG. 3 is an elevational view of another exercise machine in accordance with the prior art.

One may note that conventional exercise machines 150 having moveable handles 156 of the type shown in FIG. 3 do not require the user to balance the mass of the training load during a press exercise. Although the handles 156 of the prior art device are moveable within the training zone 186, the user is not required to control the balance of a relatively large mass such as the training load. Thus, the beneficial aspects experienced by the user may not be as thorough as that experienced by the user using the exercise machine 200.

Figure 9:
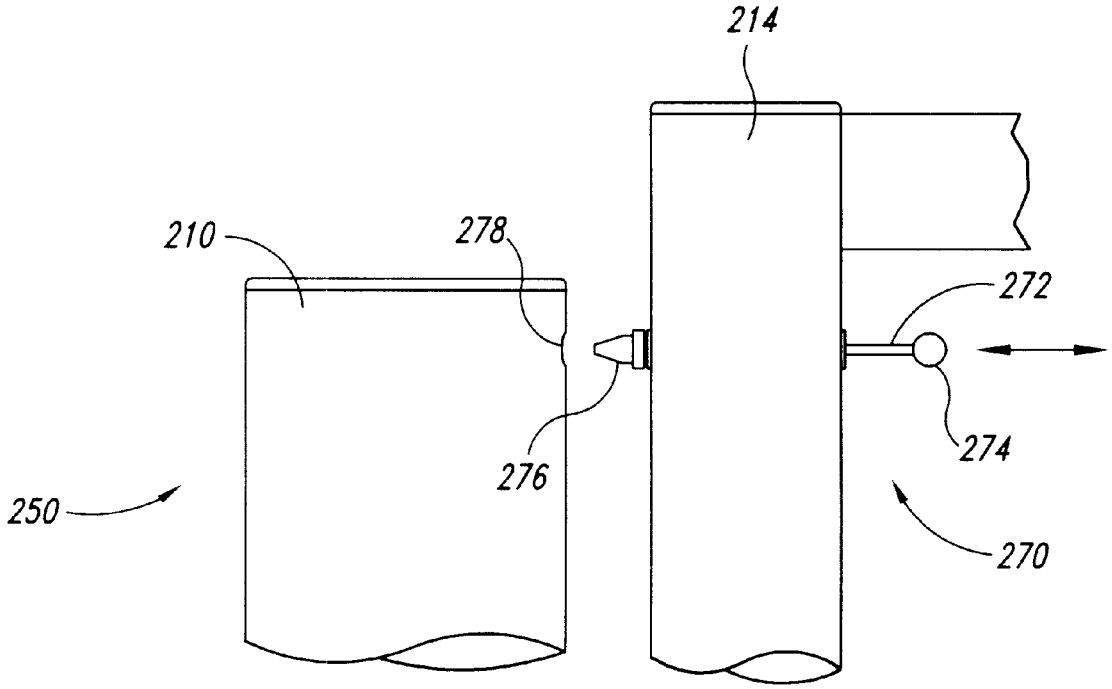
FIG. 9 is an enlarged, partial front elevational view of the weight guide and support member of the exercise machine of FIG. 4.

In a second mode of operation, the weight guide 210 may be prevented from moving. FIG. 9 is an enlarged, partial front elevational view of the weight guide 210 and the support member 214 of the exercise machine 200 of FIG. 4. As shown in this figure, the support member 214 includes a locking device 270 engageable with the upper end 250 of the weight guide 210. The locking device 270 includes a locking rod 272 having a handle 274 at one end and an engagement tip 276 at the other end. The locking rod 272 is slideably disposed through the support member 214. A locking aperture 278 is disposed within the upper end 250 of the weight guide 210. Clearly, a wide variety of alternate mechanisms may be used to prevent the weight guide 210 from moving.

In an unlocked position, as shown in FIG. 9, the engagement tip 276 is withdrawn from the locking aperture 278, permitting the weight guide 210 to rock or pivot between the fore and aft positions 256, 258 as shown in FIG. 7. In a locked position (not shown), the engagement tip 276 is inserted into the locking aperture to secure the weight guide 210 in a fixed, approximately upright position. With the locking device 270 secured in the locked position, when a user performs press exercises at the press station 202, the handles 206 are constrained to follow the fixed arc 116 (see FIG. 7).

The locking device 270 advantageously permits the user to quickly, easily, and efficiently switch between the two modes of operation of the exercise machine 200. For example, when the user desires the more strenuous mode of operation with the pivotable weight guide 210 requiring the user to balance the mass of the training load 252, the user positions the locking device 270 in the unlocked position. If, however, the user desires the conventional mode of operation with the weight guide fixed in an upright position, the user simply moves the locking device into the locked position. It should be noted that any number of different configurations of locking devices may be used, and that the invention is not limited to the particular embodiment of the locking device 270 shown in FIG. 9 and described above.

Figure 10:
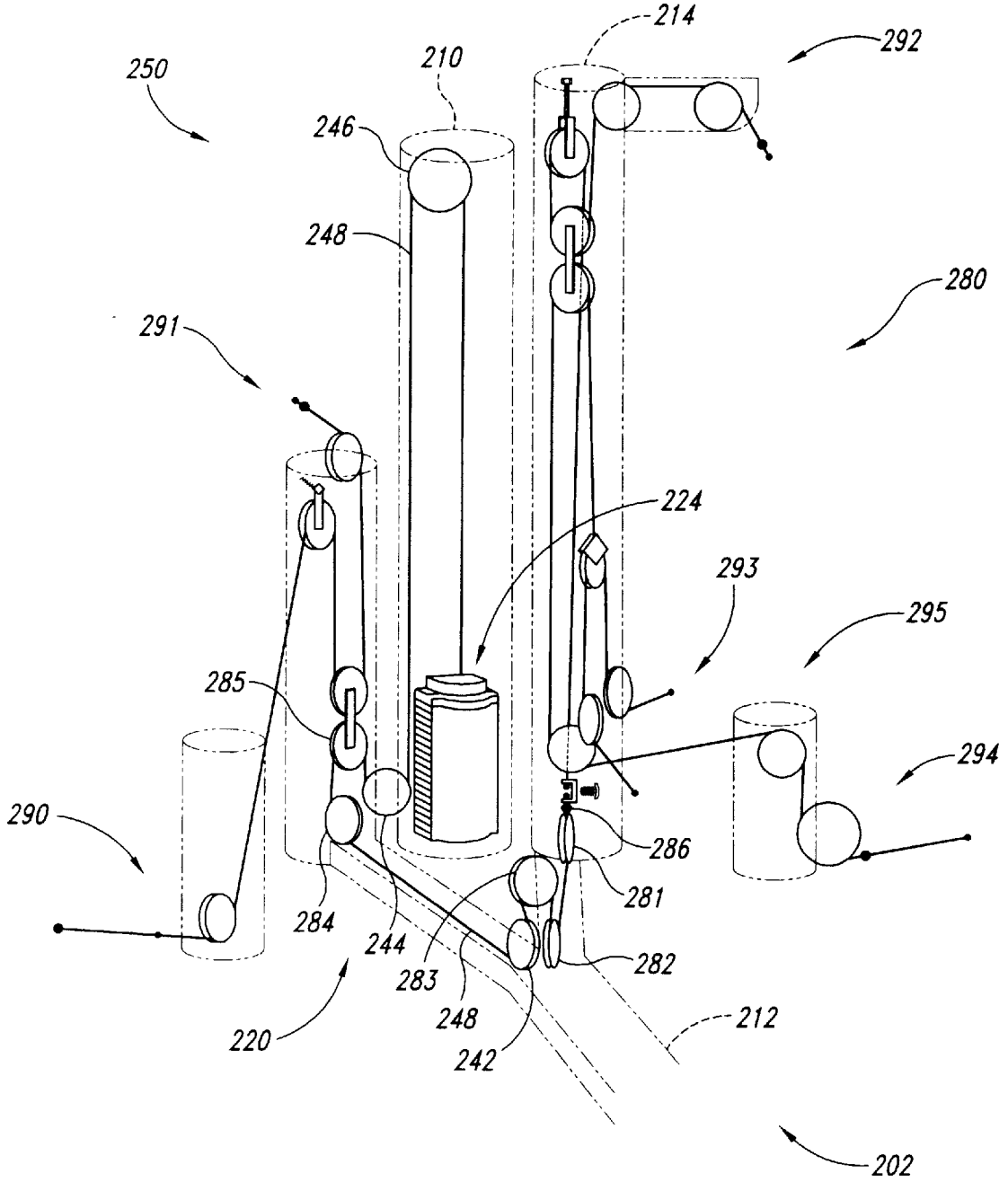
FIG. 10 is an isometric view of an embodiment of a cable-and-pulley device of the exercise machine of FIG. 4.

FIG. 10 is an isometric view of an embodiment of a cable-and-pulley device 280 of the exercise machine 200 of FIG. 4. As in the previously-described embodiment FIG. 7), the cable-and-pulley device 280 includes a cable 248, a first pulley 242 attached to the support frame 212, a second pulley 244 attached to the lower end 220 of the weight guide 210, and a third pulley 246 attached to the upper end 250 of the weight guide 210. The cable-and-pulley device 280 shown in FIG. 10, however, includes additional pulleys which cooperate with other pulley-and-cable subassemblies of the other workout stations, namely, a leg station 290, a high pulley station 292, a low pulley station 294, an abdominal station 291, and a butterfly station 293. Specific characteristics of the cable-and-pulley device 280 are described in co-pending and commonly owned U.S. patent application Ser. No. 09/500,186 entitled "Cable-and-Pulley Devices Having Intermediate Tension Isolators for Exercise Machines" filed concurrently herewith and incorporated herein by reference.

The cable-and-pulley device 280 includes a fourth pulley 281 attached to a lower end of the support member 214, a fifth pulley 282 attached to the support frame 212 proximate the first pulley 242, a sixth pulley 283 proximate the press station 202, a seventh pulley 284 attached to the support frame 212 proximate the second pulley 244, and an eighth pulley 285 proximate the leg station 290. A cable stop 286 is attached to an end of the cable 248 and engages the fourth pulley 281. The cable 248 extends from the cable stop 286 and successively engages the fourth pulley 281, the fifth pulley 282, the sixth pulley 283, the first pulley 242, the seventh pulley 284, the eighth pulley 285, the second pulley 244, and the third pulley 246, and is attached to the weight stack 224.

In this embodiment, the cable-and-pulley device 280 advantageously provides the above-described benefits of the balancing weight guide 210 in a multi-station exercise machine. The cable-and-pulley device 280 cooperates with a leg station cable-and-pulley subassembly 290, and a low pulley station cable-and-pulley subassembly 295, to permit users to perform a variety of exercises in combination with the press station 202. It should be noted, of course, that any number of cable-and-pulley device embodiments are conceivable that may be used in conjunction with the balancing weight guide 210, including embodiments having a greater number or fewer number of pulleys than the representative embodiments shown in FIGS. 7 and 10 and described above.

Figure 11:
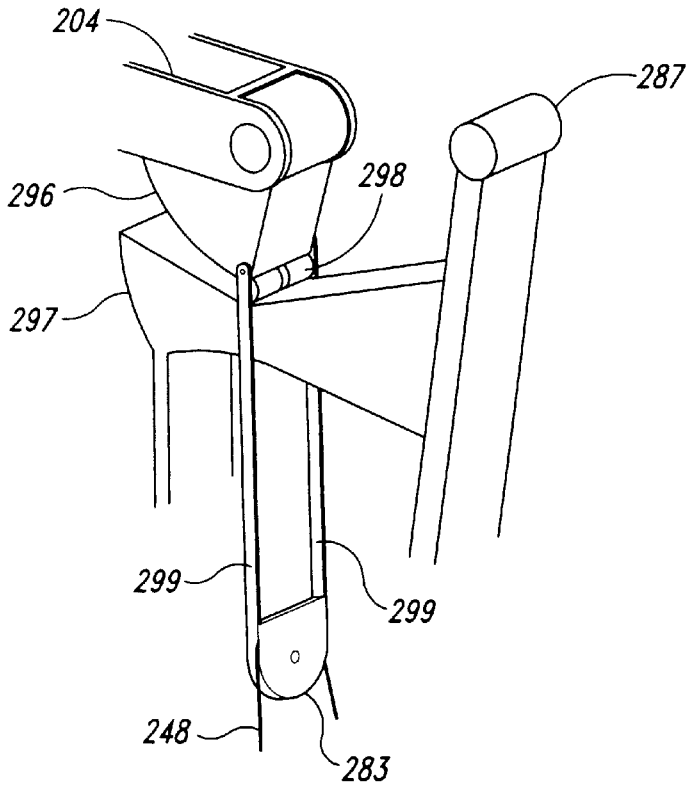
FIG. 11 is an enlarged, partial isometric view of a lift arm of the exercise machine of FIG. 4.

FIG. 11 is an enlarged, partial isometric view of the lift arm 204 of the exercise machine 200 of FIG. 4. In this embodiment, the lift arm 204 includes a centering arm 296 which projects downwardly from the lift arm 204. A centering support 297 projects upwardly from the support frame 212 (see FIG. 4) and engages the centering arm 296. A roller 298 is coupled to the centering arm 296 and rollably engages an approximately "V"-shaped portion of the centering support 297. A pair of coupling bands 299 attach the centering arm 296 of the lift arm 204 with the sixth pulley 283 of the cable-and-pulley device 280 (see FIG. 10). A stop arm 287 projects upwardly from the centering support 297.

The centering arm 296 and centering support 297 provide an automatic system of centering the position of the lift arm 204 and the handles 206 between use of the press station 202. When the lift arm 204 is lowered by the user, the roller 298 engages the V-shaped portion of the centering support 297 and automatically rolls to the lowest portion of the V-shaped portion. Because the lift arm 204 is coupled to the pivotable weight guide 210, the centering support 297 and centering arm 296 may automatically adjust the position of the weight guide 210 into an approximately vertical position (or other desired position) between uses. Thus, when the user lowers the lift arm 204, the weight guide 210 may be automatically positioned in an upright position for the next use, or for securing in the non-pivotable mode of operation using the locking device 270. The stop arm 287 may contact the lift arm 204 and may operate (along with other components) to prevent the weight guide 210 from tipping too far forward.

Figure 12:
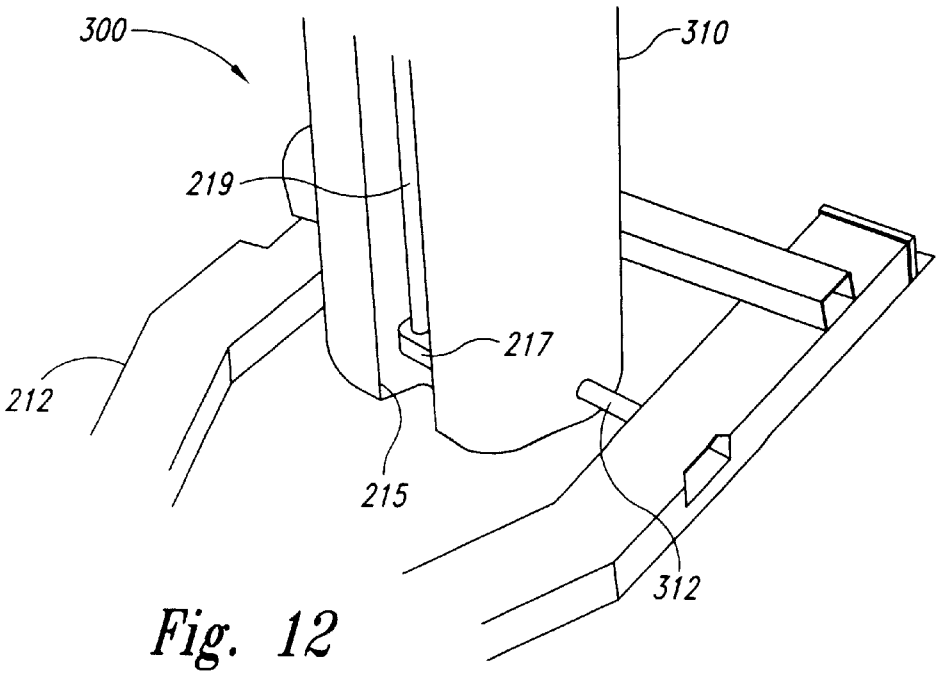
FIG. 12 is an enlarged, partial isometric view of an alternate embodiment of a lower end of a weight guide in accordance with an alternate embodiment of the invention.

FIG. 12 is an enlarged, partial isometric view of an alternate embodiment of a lower end 300 of a weight guide 310 in accordance with an alternate embodiment of the invention. In this embodiment, the weight guide 310 includes a pair of pivot rods 312 (only one visible) that project from the sides of the lower end 300 into the support frame 212. The lower end 300 is suspended above the floor (or other suitable base surface) on the pivot rods 312 and does not contact the floor. Thus, the advantages of the pivotable weight guide 310 may be achieved in an embodiment of a weight guide 310 that does not employ rockers or any other components which contact the floor or base surface.

One may note that the pivot rods 312 may be replaced with a single pivot rod that, for example, may span the width of the weight guide 310 and project out each side of the weight guide into the frame. Alternately, the pivot rods could be attached to the frame and project into the weight guide. Furthermore, the pivot rods may be located at other locations other than on the lower end of the weight guide, including at locations further away from the floor surface.

Figure 13:
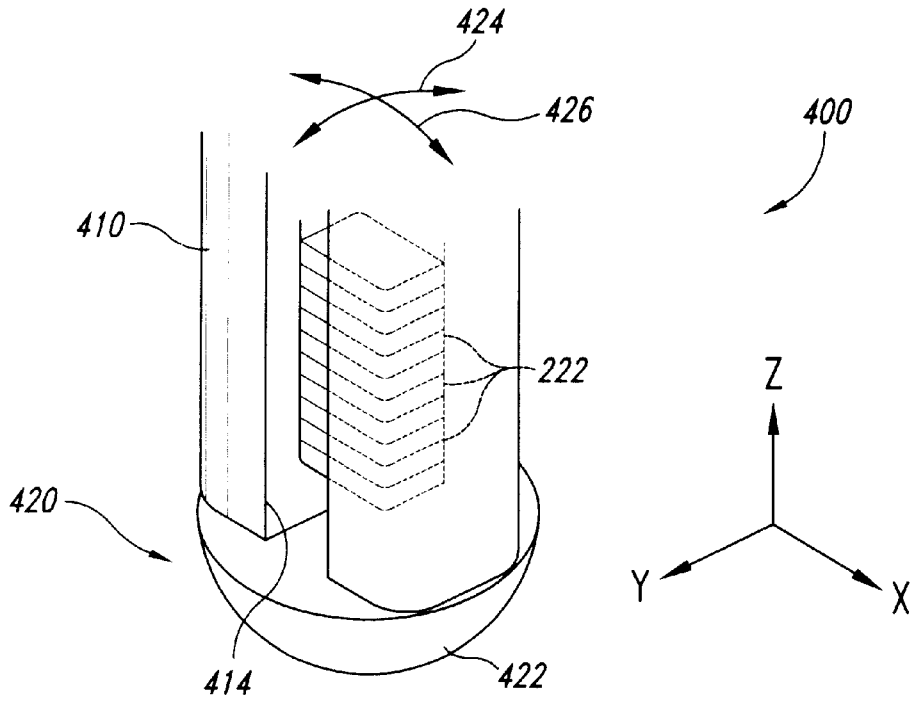
FIG. 13 is an enlarged, partial isometric view of another embodiment of a lower end of a weight guide in accordance with an embodiment of the invention.

In other embodiments, an exercise machine in accordance with the invention may include a weight guide that is pivotable in any direction. FIG. 13 is an enlarged, partial isometric view of another embodiment of a lower end 400 of a weight guide 410 in accordance with an embodiment of the invention. The weight guide 410 includes a housing 414 having a plurality of weight plates 222 slideably disposed therein. A base 420 is attached to a bottom end of the housing 414. The base 420 has a convex lower surface 422 that rests on the floor (or base surface). In the embodiment shown in FIG. 13, the lower surface 422 of the base 420 is approximately hemispherical, although a variety of suitable convex shapes may be used.

Exercise machines having the base 420 with the convex lower surface 422 advantageously permit the weight guide 410 to pivot in either a first plane of freedom 424 (the y-z plane)(as in the previously described embodiments), or in a second plane of freedom 426 (the x-z plane), or both simultaneously. Thus, the base 420 allows the weight guide 410 to pivot in any direction during the press exercise. This in turn requires the user to work harder to balance the mass of the weight guide 410 and the weight stack 224 during the press exercise. Because the weight guide 410 (and thus, the handles 206) may pivot in any direction, the user must maintain and control the position of the handles 206 in two planes of freedom. Thus, the user's trained muscle zone may be expanded in comparison with the muscle zone trained by conventional exercise machines. Furthermore, the trained muscle zone may be more thoroughly trained, and additional or secondary muscles not typically trained by some conventional exercise machines may be needed to control and maintain the balance of the pivotable weight guide 410 and load during the press exercise.

Figure 14:
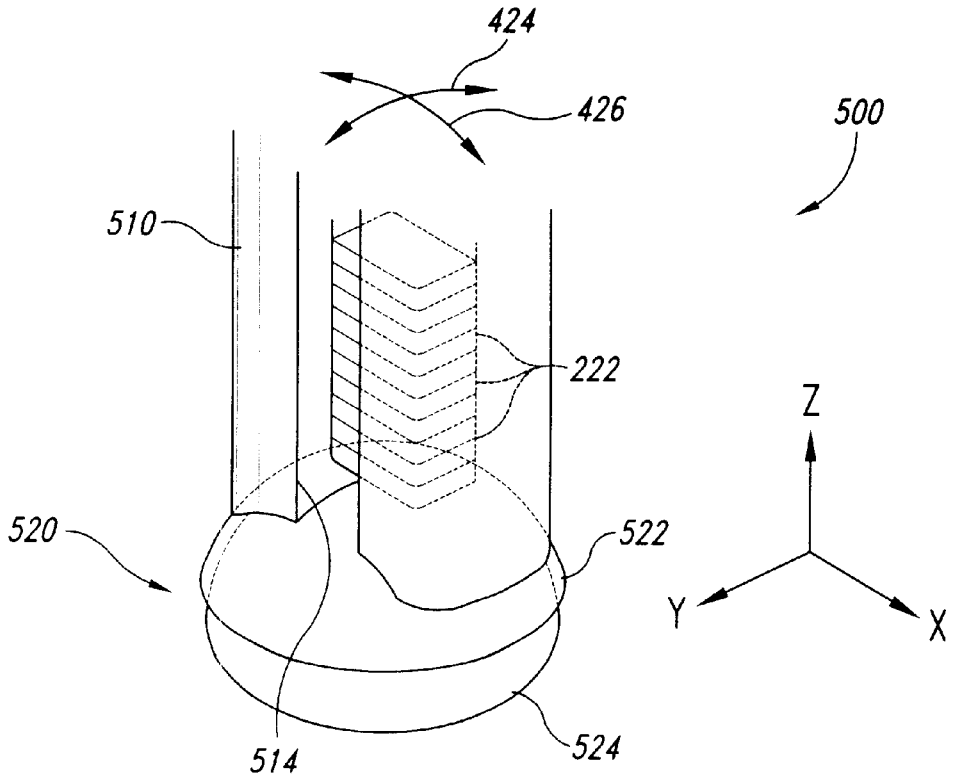
FIG. 14 is an enlarged, partial isometric view of yet another embodiment of a lower end of a weight guide in accordance with an embodiment of the invention.

FIG. 14 is an enlarged, partial isometric view of yet another embodiment of a lower end 500 of a weight guide 510 in accordance with an embodiment of the invention. In this embodiment, the weight guide 510 includes a base 520 having a concave cup 522 attached to a housing 514. A convex support 524 is positioned on the floor (or other base surface) and slideably engages the concave cup 522. The engaging surfaces of the convex support 524 and the concave cup 522 are preferably partially spherical, and may, for example, be hemispherical, although other convex or concave shapes may be used. Thus, the base 520 permits the weight guide 510 to pivot in the first plane of freedom 424 (the y-z plane), or the second plane of freedom 426 (the x-z plane), or both simultaneously. The beneficial aspects of the exercise machine having a pivotable weight guide are thereby achieved.

In alternate embodiments, the support could be concave and the cup could be convex. Alternately, the support and cup could be convex/concave in a single plane (e.g. the x-z plane), similar to the rockers 236 described above, to provide pivoting or rocking of the weight guide in a single plane of freedom.

Figure 15:
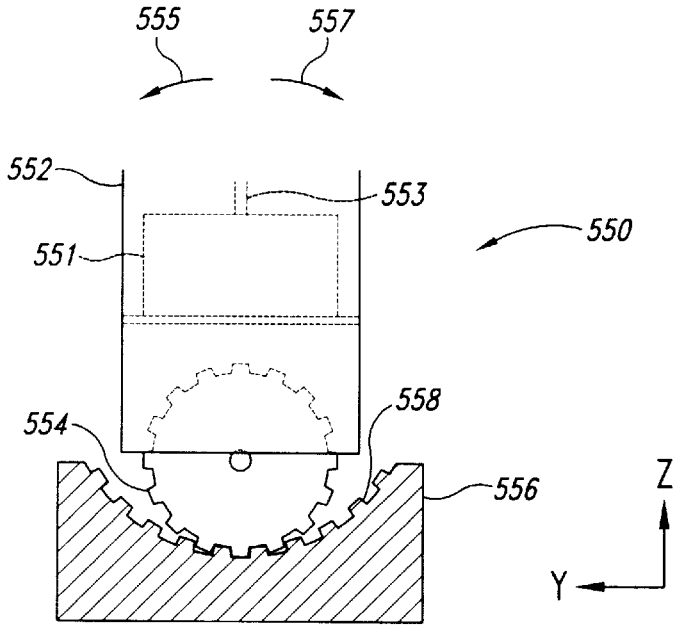
FIG. 15 is a partial cross sectional view of a weight guide in accordance with an alternate embodiment of the invention.

FIG. 15 is a partial cross sectional view of a weight guide 550 in accordance with an alternate embodiment of the invention. In this embodiment, the weight guide 550 includes a housing 552 having a rotatable gear 554. A training load 551 is disposed within the housing 552 and is attached to a linkage 553. A base 556 having a toothed engagement surface 558 is positioned below the weight guide 550. The gear 554 engages the engagement surface 558, allowing the weight guide 550 to pivot in a forward direction 555 and an aft direction 557 in the y-z plane. Thus, the advantages of an exercise machine having a balancing load may be achieved. In an alternate embodiment, the engagement surface is a smooth surface and the gear 554 is replaced with a roller that rolls on the smooth surface. In a further embodiment, the gear is replaced with a track that rollably engages the engagement surface.

It should be noted that a wide variety of alternate configurations may be conceived that provide the desired pivotability (or rockability) of the weight guide. For example, the weight guide could be pivotably coupled to a support frame by one or more hinges as disclosed in U.S. Pat. No. Re. 34,572 to Johnson and Ish, incorporated herein by reference. Alternately, the weight guide could be pivotably coupled to a support frame by one or more four-bar linkages of the type generally disclosed, for example, in U.S. Pat. No. 4,580,436 to Nelson, or U.S. Pat. No. 3,765,263 to Buscher et al, or U.S. Pat. No. 4,128,130 to Green et al, incorporated herein by reference.

Furthermore, the convex base 420 of FIG. 13 may be combined with a cup-shaped support positioned between the convex surface 422 and the floor surface 252 in variety of known "ball-in-cup" or "ball-in-socket" arrangements. Alternately, a base having a universal or multi-directional joint may be employed which permits the weight guide to pivot in either the first or second planes of freedom, or both simultaneously. Some representative embodiments of suitable joints are disclosed, for example, in U.S. Pat. No. 4,445,875 to Kosuda et al, or U.S. Pat. No. 4,065,941 to Aoki, or U.S. Pat. No. 4,116,018 to Weible, or U.S. Pat. No. 5,101,681 to Shpigel, U.S. Pat. No. 3,857,256 to Girguis, incorporated herein by reference. Thus, the advantages of a pivotable weight guide that requires the user to balance the mass of the weight guide (and the weight stack and training load) may be achieved in a variety of embodiments, and apparatus are not limited to the particular embodiments described above.

Figure 16:
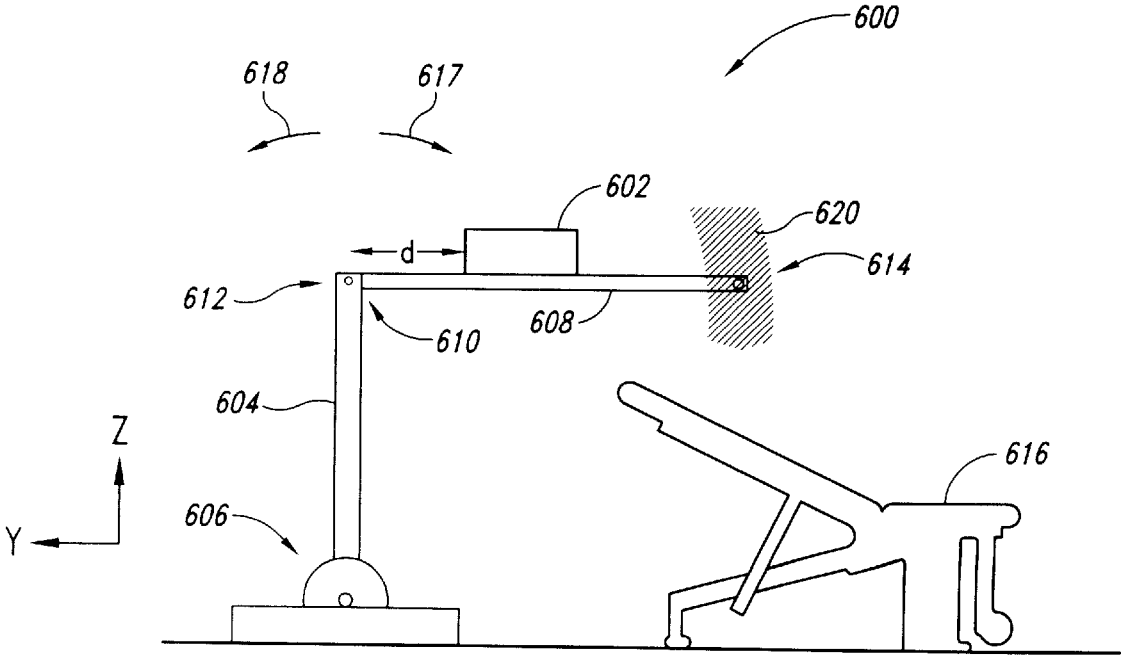
FIG. 16 is a side elevational view of an exercise machine having a balancing load in accordance with an alternate embodiment of the invention.

FIG. 16 is a side elevational view of an exercise machine 600 having a balancing load 602 in accordance with an alternate embodiment of the invention. The exercise machine 600 includes an upright support 604 having a first pivotable end 606 proximate the floor. A lift member 608 includes a first end 610 pivotably coupled to a second pivotable end 612 of the upright support 604, and a free end 614 projecting away from the upright support 604. A bench 616 may be positioned under the free end 614.

In operation, the balancing load 602 is positioned on the lift member 608 at a distance d from the upright support 604. A user applies a training force on the free end 614 of the lift member 608. The distance d (or the weight of the load 602) may be varied to increase or decrease the amount of training force that must be applied by the user to move the free end 614. As the user applies the training force, the upright support 604 is pivotable in the y-z plane in both a first direction 617 toward the free end 614, and in a second direction 618 away from the free end 614 The free end 614 is free to move within a training zone 620. Thus, the user must balance the, load 602 during the exercise. As previously described, the first pivotable end 606 of the upright support 604 may be pivotable in both the y-z plane and in the x-z plane, further increasing the balancing requirement on the user.

Figure 17:
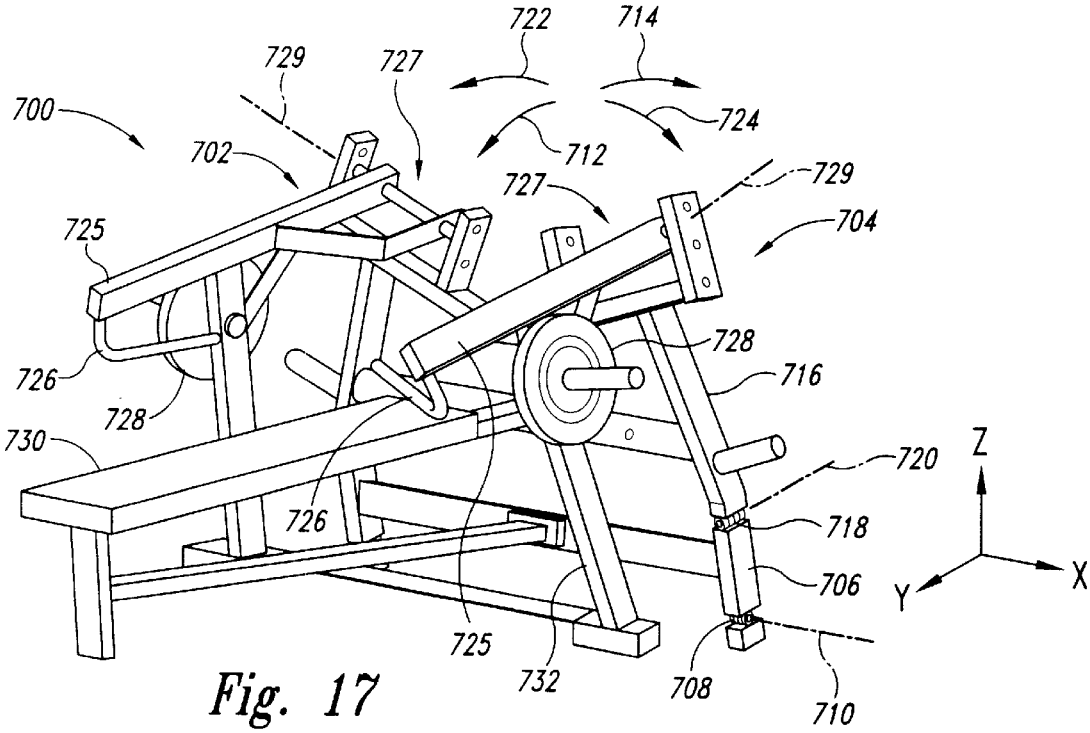
FIG. 17 is an isometric view of an exercise machine having a balancing load in accordance with another embodiment of the invention.

FIG. 17 is an isometric view of an exercise machine 700 having a balancing load 702 in accordance with another embodiment of the invention. In this embodiment, the exercise machine 700 includes a lift frame 704 having a lower member 706. The lower member 706 includes a pair of first hinges 708 (only one visible) that enable the lower member 706 to pivot about a first pivot axis 710 in a forward direction 712 and a backward direction 714 in a y-z plane. An upper member 716 is pivotably coupled to the lower member 706 by a pair of second hinges 718 (only one visible) that allow the upper member 716 to pivot =about a pair of second pivot axes 720 (only one visible) in a first and second lateral direction 722, 724 in an x-z plane.

The lift frame 704 also includes a pair of lift arms 725. Each lift arm 725 includes a handle 726 and is pivotably coupled by a first pivot mechanism 727 to the upper member 716. Each lift arm 725 is pivotable about a third pivot axis 729. A bench 730 is positioned near the handles 726. The bench 730 includes a pair of supports 732 that engage the lift frame 704 when not in use. In this embodiment, the balancing load 702 includes a pair of plates 728 positioned on the lift frame 704. In operation, a user (not shown) is positioned on the bench 730 and applies a training force one or both of the handles 726. When the training force on one of the handles 726 overcomes the gravitational force on the plate 728, the handle 726 moves away from the user, pivoting the lift arm 725 about the third pivot axis 729. When the user overcomes the gravitational force on both plates 728, both lift arms 725 are pivoted about the third pivot axes 729, and the lift frame 704 lifts off the supports 732 into a raised position. In the raised position, the balancing load 702 is moveable in the forward and backward directions 712, 714 as the lower member 706 pivots about the first pivot axis 710. The balancing load 702 is also moveable in the first and second lateral directions 722, 724 as the upper member 716 pivots about the pair of second pivot axes 720. Thus, the user must balance the mass of the balancing load 702 in two planes of freedom during the exercise.

Figure 18:
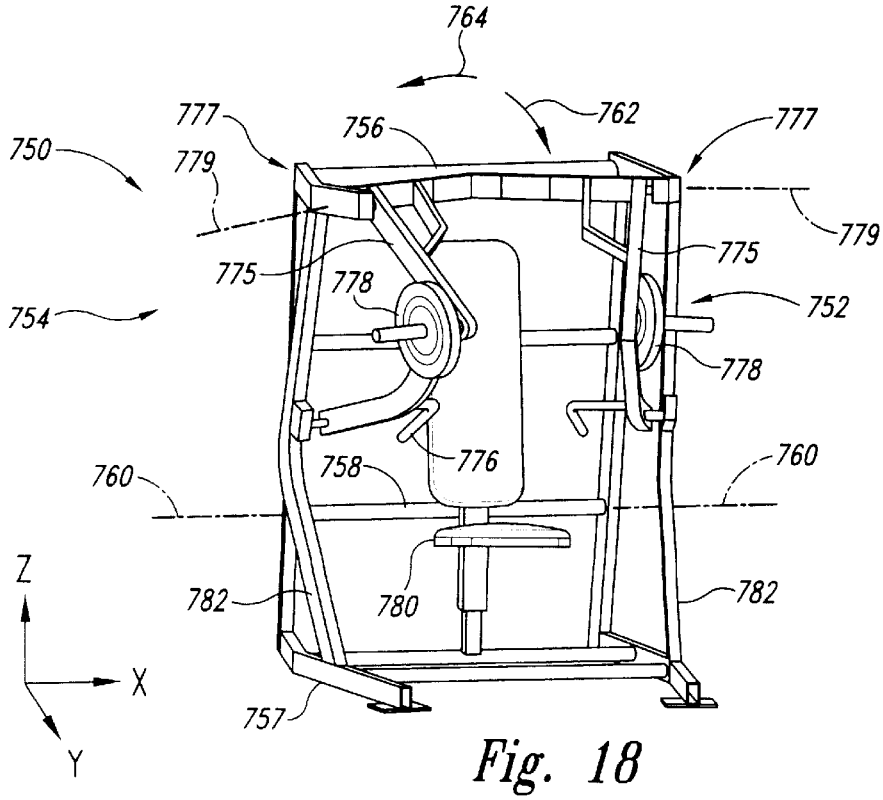
FIG. 18 is an isometric view of an exercise machine having a balancing load in accordance with yet another embodiment of the invention.

FIG. 18 is an isometric view of an exercise machine 750 having a balancing load 752 in accordance with yet another embodiment of the invention. The exercise machine 750 includes a lift frame 754 having an upper member 756 and a base member 757 that rests on the floor. The upper member 756 is pivotably attached to the base member 757 by a pivot member 758 that enables the upper member 756 to pivot about a first pivot axis 760 in a forward direction 762 and a backward direction 764 in a y-z plane.

The lift frame 754 further includes a pair of lift arms 775. Each lift arm 775 includes a handle 776 and is pivotably coupled by a first pivot mechanism 777 to the upper member 756. Each lift arm 775 is pivotable about a second pivot axis 779. A seat 780 is positioned near the handles 776 and is attached to the base member 757. The base member 757 includes a pair of upright supports 782 that engage the lift arms 775 when not in use. The balancing load 752 includes a weight 778 positioned on each lift arm 775.

In operation, a user (not shown) is positioned on the seat 780 and applies a training force one or both of the handles 776. When the training force on one of the handles 776 overcomes the gravitational force on the weight 778, the handle 776 moves away from the user, pivoting the lift arm 775 about the second pivot axis 779. When the user overcomes the gravitational force on both weights 778, both lift arms 775 are pivoted about the second pivot axes 779, and the lift arms 775 lift off the supports 782 into a raised position. In the raised position, the balancing load 752 is moveable in the forward and backward directions 762, 764 as the upper member 756 pivots about the first pivot axis 760. Thus, the user must balance the mass of the balancing load 752 in the y-z plane of freedom as the handles 776 are moved away from the user.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other apparatus and methods for exercise machines having balancing loads, and not just to the embodiments described above and shown in the accompanying figures. Accordingly, the scope of the invention should be determined from the following claims.

What is claimed is:

1. An exercise machine, comprising:

a load guide projecting approximately upwardly and being pivotable through at least a portion of a first plane of freedom;

a load slideably engaged with the load guide;

a lift arm having a first end pivotably coupled to the load guide and a second end projecting away from the load guide, the lift arm being moveable with the load guide so that a balancing force applied at the second end is transmitted to the load guide; and a cable-and-pulley device operatively coupled to the load and to the lift arm so that a training force applied at the second end induces a lift force on the load.

2. The exercise machine of claim 1 wherein the load guide includes a lower end, the load guide being pivotable about the lower end.

3. The exercise machine of claim 1 wherein the load guide includes a lower end and having at least one rocker engageable with a base surface.

4. The exercise machine of claim 1 wherein the load guide includes a convex surface pivotably engageable with a base surface.

5. The exercise machine of claim 4 wherein the convex surface comprises a two-dimensionally convex surface.

6. The exercise machine of claim 4 wherein the convex surface comprises a partially spherical surface.

7. The exercise machine of claim 1, further comprising a stationary support proximate the load guide.

8. The exercise machine of claim 7 wherein the support includes a locking device engageable with the load guide to secure the load guide in a fixed position.

9. The exercise machine of claim 1 wherein the lift arm includes downwardly projecting a centering arm, further comprising a support frame engageable with a base surface and having a centering support engageable with the centering arm.

10. The exercise machine of claim 9 wherein the centering support includes an approximately V-shaped portion engageable with the centering arm.

11. The exercise machine of claim 1 wherein the load comprises a weight stack.

12. The exercise machine of claim 1 wherein the cable-and-pulley device includes a first pulley proximate the lift arm, a second pulley proximate a lower end of the load guide, a third pulley proximate an upper end of the load guide, and a cable coupled between the lift arm and the load and operatively engaged with the first, second, and third pulleys.

13. The exercise machine of claim 1, further comprising a base pivotably coupled to the load guide.

14. The exercise machine of claim 13 wherein the base includes a convex portion and the load guide includes a concave portion slideably engaged with the convex portion.

15. The exercise machine of claim 13 wherein the base includes a concave portion and the, load guide, includes a convex portion slideably engaged with the concave portion.

16. An exercise machine operable on a floor surface, comprising:

a load guide projecting approximately upwardly from the floor surface and being pivotable through at least a portion of a first plane of freedom, the load guide having a lower portion proximate the floor surface and an upper portion remote from the floor surface;

a load slideably engaged with the load guide;

a lift arm having a first end pivotably coupled to the load guide and a second end projecting away from the load guide, the lift arm being moveable with the load guide so that a balancing force applied at the second end is transmitted to the load guide; and a cable-and-pulley device including a cable and at least one pulley, the cable-and-pulley device being attached to the load and to the lift arm, the cable being operatively engaged with the at least one pulley such that a training force applied to the second end induces a lift force on the load.

17. The exercise machine of claim 16 wherein the cable-and-pulley device comprises a first pulley proximate the lift arm, a second pulley proximate a lower end of the load guide, a third pulley proximate an upper end of the load guide, the cable being operatively engaged with the first, second, and third pulleys.

18. The exercise machine of claim 16 wherein the lower portion includes a lower end at least proximate the floor surface, the load guide being pivotable about the lower end.

19. The exercise machine of claim 16 wherein the lower portion includes at least one rocker rockably engageable with the floor surface.

20. The exercise machine of claim 16 wherein the load guide includes a convex surface pivotably engageable with the floor surface.

21. The exercise machine of claim 16 wherein the load guide includes a concave portion, further comprising a base having a convex portion slideably engaged with the concave portion.

22. The exercise machine of claim 16 wherein the load guide includes a convex portion, further comprising a base having a concave portion slideably engaged with the convex portion.

23. An exercise machine operable on a floor, comprising:

a support having a first end proximate the floor and a second end spaced apart from the floor, the support being pivotable about the first end; a lift member having a third end pivotably coupled to the second end and a fourth end projecting away from the support;

a load coupled to the lift member so that as a training force is applied at the fourth end, the load is at least partially balanceable on the support by the training force; and a force-transmitting mechanism coupled between the lift member and the load, wherein the force-transmitting mechanism comprises a cable-and-pulley device.

24. The exercise machine of claim 23 wherein the support is pivotable about the first end in at least a portion of a single plane of freedom.

25. The exercise machine of claim 23, further comprising a base resting on the floor, the first end being pivotably coupled to the base.

26. The exercise machine of claim 23 wherein the load comprises a weight stack.

* * * * *